US005769207A

United States Patent [19]

Christian

[11] Patent Number: 5,769,207

[45] Date of Patent: Jun. 23, 1998

[54] KEY OPERATED VEHICLE ANTI-THEFT ELECTRICAL SWITCHING DEVICE

[75] Inventor: Gary Christian, Moordown Bouenemouth, United Kingdom

[73] Assignee: Robin P. Whitfield, Calgary, Canada

[21] Appl. No.: 739,046

[22] Filed: Oct. 28, 1996

[51] Int. Cl.[6] ..... H01H 27/06

[52] U.S. Cl. ..... 200/43.08; 200/500; 200/572

[58] Field of Search ..... 200/572, 43.08, 200/500

[56] References Cited

U.S. PATENT DOCUMENTS

| | | | |
|---|---|---|---|
| 3,819,894 | 6/1974 | Flumignan et al. | 200/500 X |
| 3,894,207 | 7/1975 | Jelley | 200/572 X |
| 4,358,649 | 11/1982 | Petz | 200/572 X |
| 4,890,006 | 12/1989 | Huang | 200/43.08 |

*Primary Examiner*—Renee S. Luebke

*Attorney, Agent, or Firm*—David S. Thompson

[57] ABSTRACT

A vehicle anti-theft device is disclosed. The anti-theft device provides a key operated switch that makes or breaks the electrical continuity of four electrical circuits. These electrical circuits are essential to the operation of the vehicle; therefore their discontinuity prevents vehicle operation. A lock housing carries a lock having a rotating spindle. The spindle carries a perpendicular drive pin which engages a bushing having a helix shaped groove in its interior surface. A tab-like raised key sliding in a keyway slot in the housing prevents the bushing from rotating. Therefore, rotation of the spindle creates an axial movement of the bushing. A male contact block, carrying four U-shaped solid contact pins may be extended by the axial movement of the bushing to engage a female contact block carrying eight female socket contacts which are connected to eight in-coming wires. When extended, each U-shaped pin creates electrical continuity between a pair of wires. When retracted, the four circuits are electrically discontinuous, and the vehicle operation is prevented.

6 Claims, 3 Drawing Sheets

380
264
263
381
261
340
382
241
240
300
280
260
262
302

368
260
367
361
365
360
342
364
363
341
220
241
242
200
290
285
280
140
120
125
100

360
366
240
320
220
362
200
280
160
140
120

KEY OPERATED VEHICLE ANTI-THEFT ELECTRICAL SWITCHING DEVICE

CROSS-REFERENCES

There are no applications related to this application filed in this or any foreign country.

BACKGROUND

The need for new and improved vehicle anti-theft devices is well-known. Because many existing anti-theft devices are expensive to buy and install, the need for low cost anti-theft devices is even greater. As a result, many cars are not protected, or have been protected at considerable expense.

Additionally, due to the difficulty of installation, many vehicle anti-theft devices are not suitable for sale as an after-market product, and are therefore not available for use on used cars. As a result, drivers desiring upgraded protection may be unable to obtain it.

A further problem common to most inexpensive vehicle anti-theft devices that are available on the after-market, is that they are difficult and cumbersome to use and store in the car. Many such devices require attachment to the steering wheel. The effort and time spent in this attachment process may reduce the frequency of use and therefore the overall effectiveness of the device.

SUMMARY

The present invention is directed to an apparatus that obviates the above problems. A novel key operated vehicle anti-theft device is provided that prevents operation of as many as four electrical circuits by locking them in the open state. A key mechanism drives a lock spindle which in turn drives a bushing having internal spiral or helix-like grooves which translate the rotary motion of the spindle into an axially directed linear motion. The linear motion causes a male contact block to move, engaging or disengaging a female contact block, thereby opening or closing a circuit.

A preferred version of the key operated vehicle anti-theft switching device of the present invention provides:

(a) A device housing, typically made of metallic alloy, is generally cylindrical in shape and forms a lengthwise axial chamber. An axially oriented keyway is a channel or groove in the internal surface of the device housing that prevents rotation of the helix bushing, as will be seen.

(b) A lock mechanism, having a cylindrical lock barrel and an associated cylindrical spindle is carried by the device housing. Rotation of the appropriate key in the lock barrel causes rotation of the spindle in a similar direction with respect to the lock barrel and the lock housing. A drive pin, carried by the rear end of the spindle and oriented perpendicularly to the lock mechanism and spindle, engages the helix bushing.

(c) A helix bushing is sized to slide axially within the device housing. A raised key carried by the external surface of the bushing slides within the axially oriented keyway in the device housing, which prevents rotation of the bushing. The bushing provides an interior surface having one or more helix-shaped or spiraling grooves. The grooves are sized to engage the drive pin rotatably carried by the spindle. Because the spindle and drive pin are unable to move in the axial direction, and because the helix bushing is unable to move in a rotary manner due to the raised key, rotation of the spindle and drive pin causes the helix bushing to move in the axial direction.

(d) A male contact block is carried by the helix bushing. A rear interlock structure of the helix bushing mates with a front interlock structure of the male contact block. The male contact block is also sized to slide axially within the lock housing. The male contact block carries four U-shaped solid contact pins which may be extended and retracted by turning the key in the locking unit.

(e) A female housing, carrying eight female socket contacts, is carried by the device housing. Each female socket contact provides a cylindrical socket and a crimp connector, which is attached to the conductor of an incoming wire. When the male contact block is fully extended, the two prongs of each of the four U-shaped solid contacts pin is inserted into associated cylindrical sockets of the female socket contacts, thereby electrically connecting each pair of the eight wires. When the male contact block is retracted the four pairs of wires are electrically disconnected.

It is therefore a primary advantage of the present invention to provide a novel vehicle anti-theft device that allows a driver to disable a car by creating electrical discontinuities in up to four electrical circuits by means of a keyed switching device.

Another advantage of the present invention is to provide a vehicle anti-theft device that is easily concealed and that is not typically expected by car thieves.

Another advantage of the present invention is to provide a vehicle anti-theft device that is inexpensive to purchase and to install.

Another advantage of the present invention is to provide a vehicle anti-theft device that is easy for a driver to consistently use when leaving the car.

A still further advantage of the present invention is to provide a vehicle anti-theft device that may be installed easily as an after-market product, and that is easily adapted to almost any motor vehicle or engine powered vehicle.

DRAWINGS

These and other features, aspects, and advantages of the present invention will become better understood with regard to the following description, appended claims, and accompanying drawings where:

Figure 19:
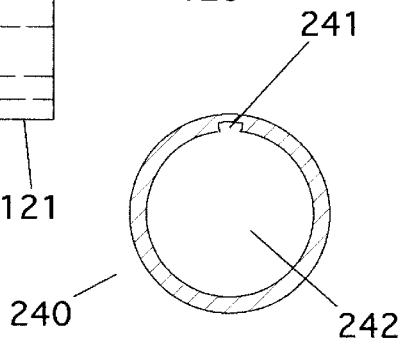
Figure 18:
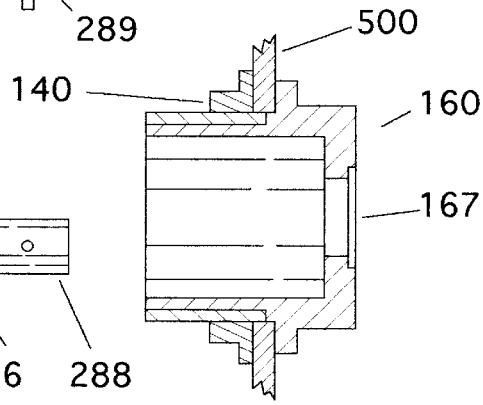

FIG. 18 a side cross-sectional view of the threaded lock housing, locknut and a vehicle dashboard, with the device housing removed for clarity; and FIG. 19 is a cross-section of the device housing alone, showing in particular the structure of the keyway.

DESCRIPTION

Figures 1, 2, 3:
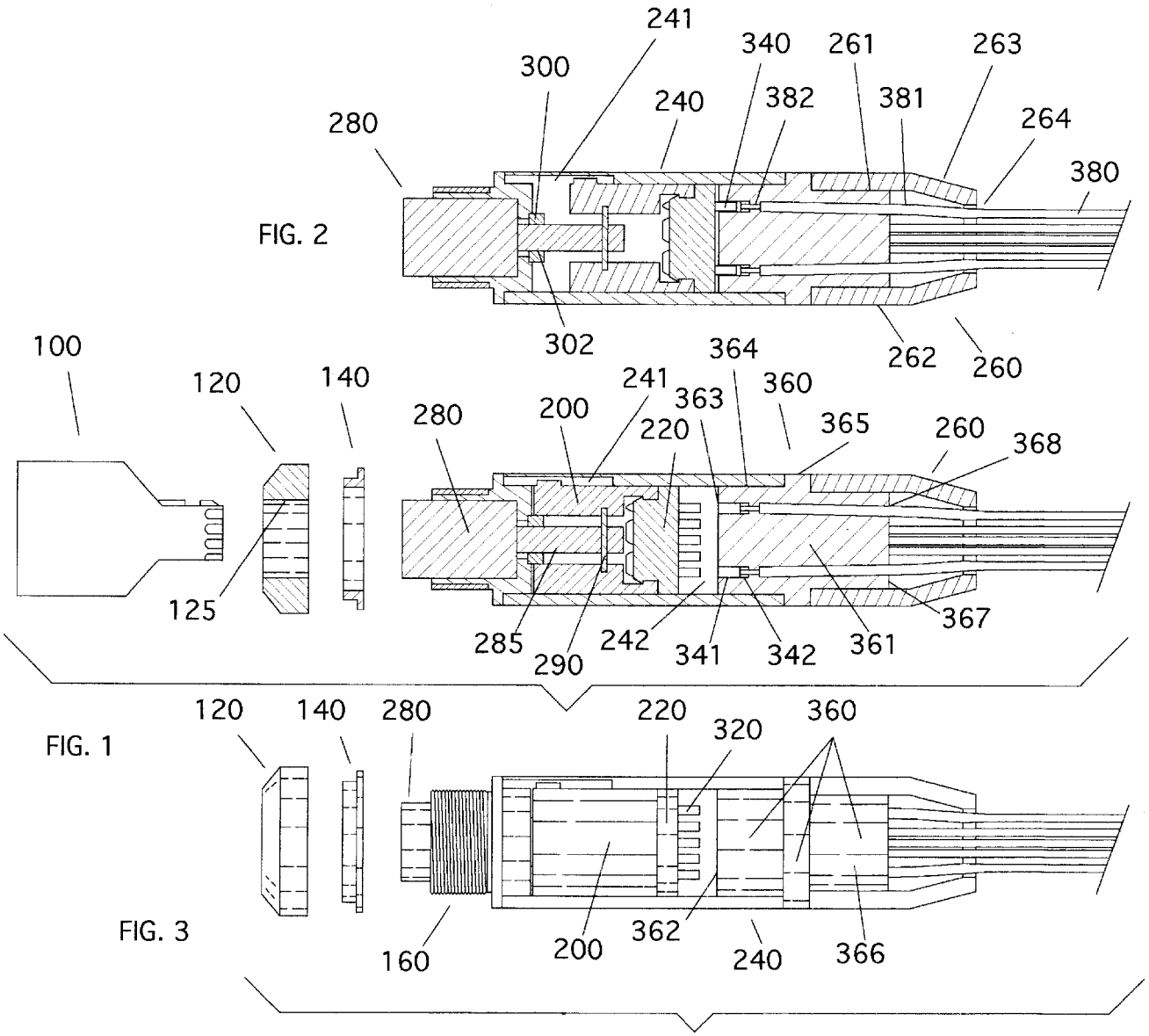
FIG 1 is an exploded lengthwise cross-section of a version of the invention showing the male contact block withdrawn from the female contact block.
FIG. 2 is a lengthwise cross-section of the version of the invention of FIG. 1, having the male contact block positioned adjacent to the female contact block, and the U-shaped solid contact pins inserted into the female socket contacts.
FIG. 3 is an exploded lengthwise view of the version of the invention of FIG. 1, having one side of housing body removed, so that the interior components are visible.

Referring in particular to FIGS. 1, 2 and 3, a key operated vehicle anti-theft electrical switching device constructed in accordance with the principles of the invention is seen. A device housing 240 carries a lock mechanism 280 having a rotating spindle 285. The spindle carries a perpendicular drive pin 290 which engages a helix bushing 200 having one or more helix-shaped grooves in its interior surface. A raised key 203, carried by bushing 200 slides in a keyway 241 in the device housing 240, prevents the bushing from rotating. Therefore, rotation of the spindle creates an axial movement of the bushing. A male contact block 220 is carried by the helix bushing 200. The male contact block carries four U-shaped solid contact pins 320 and may be extended by the axial movement of the bushing to engage a female contact block 360 carrying four pairs of female socket contacts 340 which are connected to eight wires from four circuits. When extended, each U-shaped pin creates electrical continuity between a pair of wires. When retracted, the four circuits are electrically discontinuous, and the vehicle operation is thereby prevented.

Referring to FIG. 1, the device housing 240 is generally cylindrical and defines an elongate, lengthwise axial chamber 242. As seen by comparison of FIGS. 2 and 19, a keyway 241 is an elongate channel in the inside wall of the housing 240.

Figure 16:
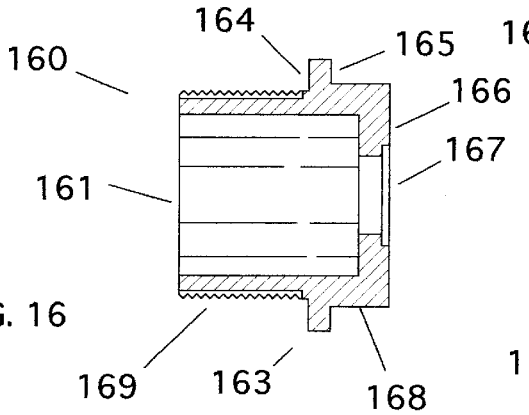
FIG. 16 is a side cross-sectional view of the lock housing.
Figure 17:
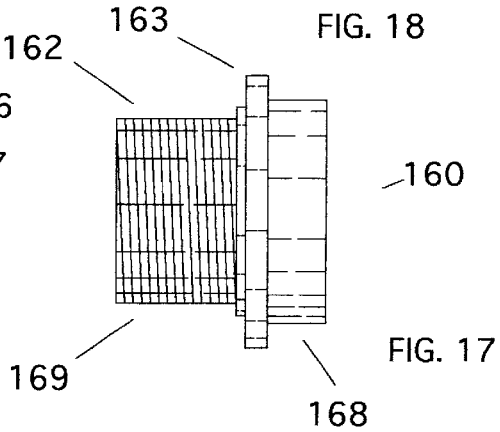
FIG. 17 is a side view of the lock housing.

As seen in FIGS. 1–3, a threaded lock housing 160 is carried by device housing 240. Referring also to FIGS. 16, 17 and 18, it is seen that threaded lock housing 160 provides a generally cylindrical body 162 having circular front opening 161. As seen in FIGS. 1 and 2, a cylindrical rearward portion 168 of the lock housing is incrementally smaller in outside diameter than the inside diameter of the device housing 240, thereby providing a frictional means by which the threaded lock housing 160 is attached to the device housing 240. An annular flange 163 provides a rear annular surface 165 that in the assembled condition is adjacent to the front edge of device housing 240. Flange 163 also provides a front annular surface 164 which is abutted against the backside of the vehicle's dashboard or other supporting surface after installation. A rear end wall 166 provides a round hole 167 through which the spindle 285 passes. A threaded section 169 is integral with the forward end of the threaded lock housing, being formed or cut into the surface of the threaded lock housing, and provides external threads sized to fit the Internal threads of the locknut 140.

Figure 4:
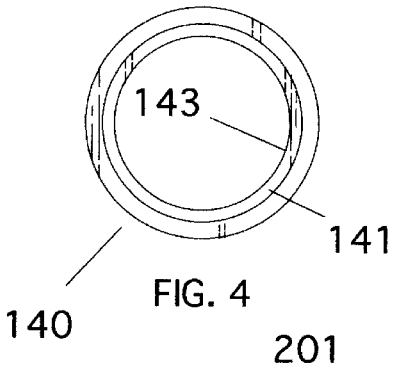
FIG. 4 is a view of the front surface of the locknut.
Figure 5:
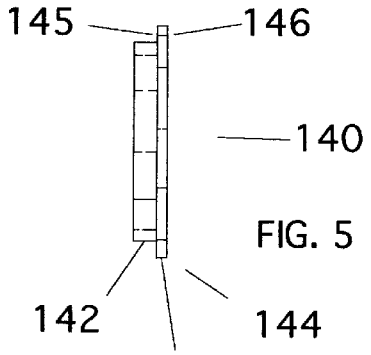
FIG. 5 is a side view of the locknut of FIG. 4.

Locknut 140, as seen in FIGS. 1, 3, 4, 5 and 16, allows the anti-theft switching device to be installed on a planar supporting structure, typically a vehicle dashboard, by squeezing the planar structure between the locknut and the annular flange 163 of the lock housing. As seen in FIGS. 4 and 5, the locknut provides an annular forward surface 141, a smooth outside cylindrical surface 142, and a threaded inside surface 143, having threads sized to mate with the threads 169 of the threaded lock housing 160. An annular flange 144 provides a front surface 145, a rear surface 146 and a cylindrical edge surface 147.

As seen in FIGS. 1–3, 14 and 15, in the preferred embodiment, a lock mechanism 280 is of the type having a round key. The lock mechanism provides a lock barrel 281 having a cylindrical sidewall 284 and a circular front end 282 containing a keyhole opening. A circular rear end 283 is supported by the rear end wall 166 of the lock housing 160.

Figure 14:
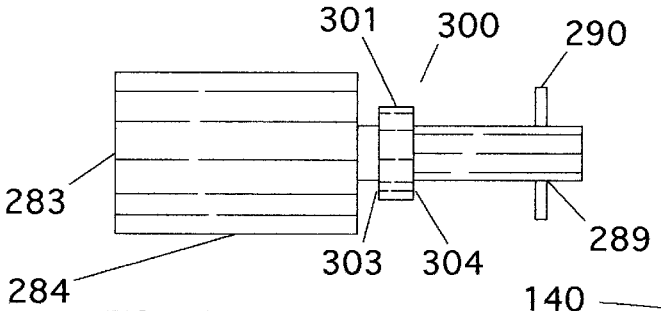
FIG. 14 is a side view of the lock mechanism, showing the cylindrical lock barrel, the spindle and the drive pin, with the retaining bushing installed.
Figure 15:
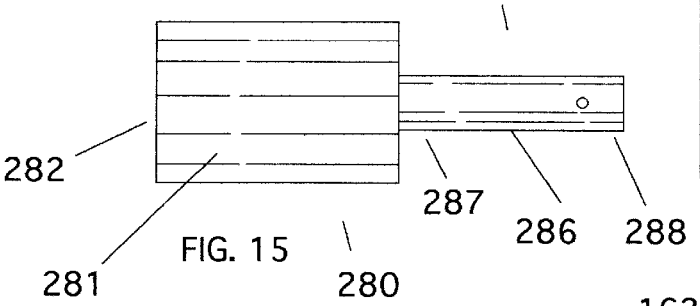
FIG. 15 is a side view of the lock mechanism of FIG. 14, having the spindle and drive pin rotated 90 degrees and the retaining bushing removed.

A spindle 285 having a cylindrical body 286 is integral with the lock barrel 281. The rear end 288 of the spindle provides holes 289 supporting the drive pin 290, as seen in FIGS. 14 and 15.

A faceplate bezel 120 is provided mainly for cosmetic reasons. As seen in FIGS. 1, 3, 12 and 13, the faceplate provides a cylindrical side 121 and a conical front 122. An annular rim 123 surrounds a center opening 124 which frames the lock barrel in the locking mechanism 280 in an esthetic manner. An inside cylindrical surface 125 is sized to frictionally engage the cylindrical side 284 of the lock mechanism 280.

As seen in FIGS. 1 and 2, a retaining bushing 300 is carried by the front end 287 of spindle 285. The retaining bushing provides an outside cylindrical surface 301, an inside cylindrical surface 302, and front and rear annular surfaces 303, 304. The retaining bushing aids in assembly of the switching device, by retaining the helix bush 200 on the lock spindle 286 by frictional means.

As seen in FIGS. 1, 2 and 6–8, a helix bushing 200 provides a generally cylindrical body 201 defining an axial channel 202 and front and rear annular surfaces 208, 209. A raised key 203 is carried by the outside surface of the body 201. The key is tab-like, and is longer in the axial direction of the bushing 200. The raised key 203 is sized appropriately to travel freely within keyway channel 241 of the device housing 240. A rear interlock structure 204 is provided to connect the helix bushing 200 with the male contact block 220. The rear interlock structure provides an annular recess 205, an annular rib 206 and an annular shoulder surface 207.

Figure 6:
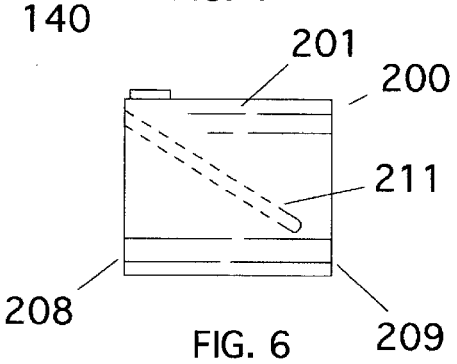
FIG. 6 is a right side view of the helix bushing, showing the right helix groove in dotted outline.
Figure 7:
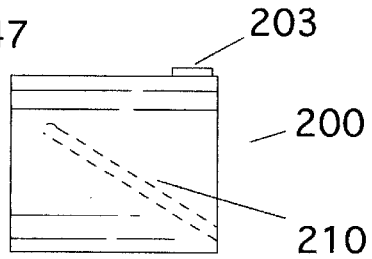
FIG. 7 is a left side view of the helix bushing, showing the left helix groove in dotted outline.
Figure 8:
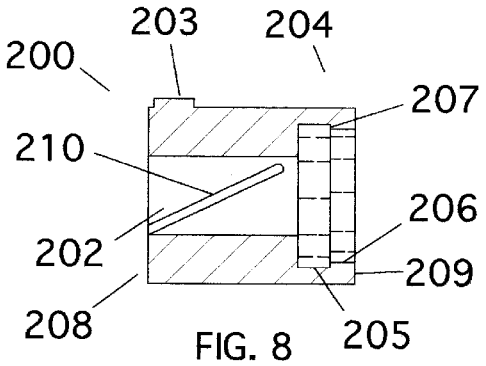
FIG. 8 is a cross-section of the helix bushing of FIG. 6, showing the left helix groove in the Ieft side of the bushing.

Referring to FIGS. 6–8, the left and right helix grooves 210, 211, for which the helix bushing is named, are seen. In the preferred embodiment of the invention, left and right grooves are provided. In alternative species of the invention, a single helix groove may be used, although this is not preferred. In either case, the groove(s) are defined in the cylindrical inside surface of the cylindrical body 201. The helix grooves are sized to engage the ends of the drive pin 290. As can be readily understood by inspection of FIGS. 1, 2 and 19, the raised key 203 of the helix bushing is constrained to travel in the keyway 241 of the device housing 240. As a result, the helix bushing is not allowed to rotate. As a result, rotation by the spindle and drive pin, upon a key turning the lock mechanism, results in the helix bushing moving in an axial direction.

Figure 9:
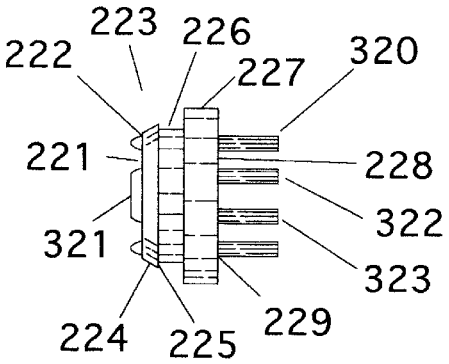
FIG. 9 is a side view of the male contact block, showing the upper, lower and right U-shaped contact pins.
Figure 10:
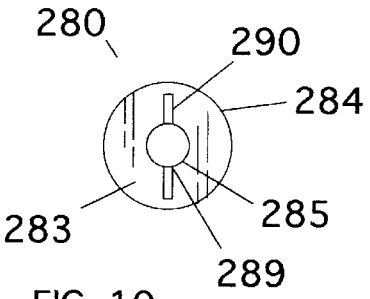
FIG. 10 is a view of the rear end of the lock mechanism, showing the cylindrical lock barrel, the spindle, and the drive pin.
Figure 11:
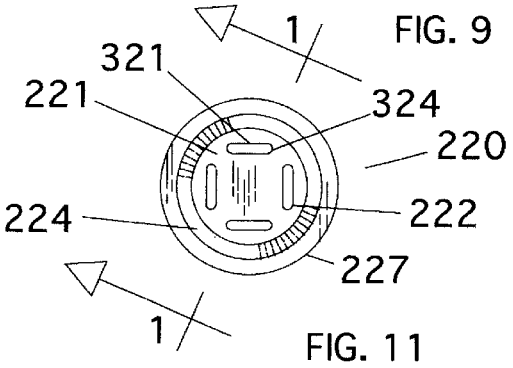
FIG. 11 is an end view of the front end of the male contact block of FIG. 9, showing by means of the 1—1 lines the orientation of the male contact block shown in cross-section in FIGS. 1 and 2.
Figure 12:
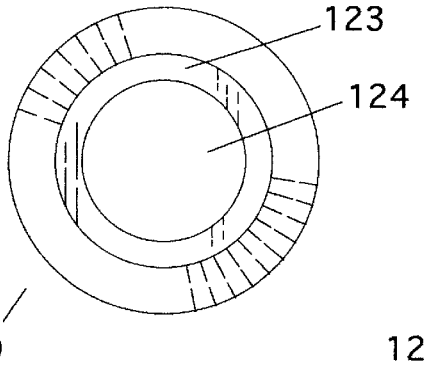
FIG. 12 is a front end view of the faceplate bezel.
Figure 13:
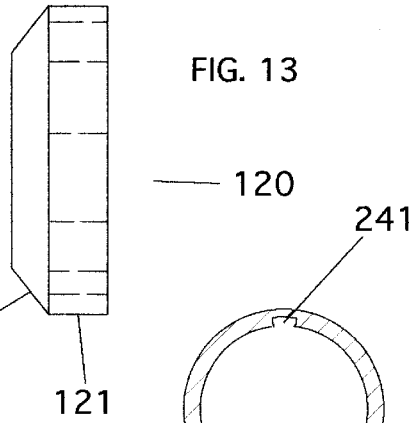
FIG. 13 is a side view of the faceplate bezel of FIG. 12.

A male contact block 220, whose motion is determined by the movement of the helix bushing, slides between a first position, as seen in FIG. 1, and a second position, as seen in FIG. 2. Cylindrical body 227 is sized appropriately to allow the contact block to slide within the axial chamber 242 of the device housing 240. As seen in FIG. 11, the male contact block provides a front circular surface 221 having holes 222 for U-shaped solid contact pins 320. A similar rear circular surface 228 having exit holes 229 for contact pins is seen in FIG. 9. A front interlock structure 223 allows the male contact block to be attached to the helix bushing 200. The interlock structure provides a conical rim 224, an annular shoulder surface 225 and an annular recess 226. The conical rim 224 allows easy insertion of the front interlock structure 223 into the rear interlock structure 204 of the helix bushing 200. The angled shape of the conical rim 224 tends to spread the annular rib 206 of the helix bushing. The annular shoulder surface 225 of the front front interlock structure may be snapped into place adjacent to the shoulder surface 207 of the rear interlock structure of the helix bushing by applying gentle pressure. Annular recess 226 is sized to provide sufficient room for annular rib 206.

As seen in FIGS. 1, 2, 9 and 11, U-shaped solid contact pins 320 are carried by the male contact block. The purpose of the movement of the male contact block is to position the contact pins in either of two positions. Each contact pin provides a base 321 having first and second 90 degree bends 324 creating first and second prongs 322, 323. If the preferred embodiment, four contact pins are provided, which can be referred to as the upper, lower, left and right contact pins. Each contact pin is frictionally fit and held in place in the holes 222, 229 on the front and rear surfaces of the male contact block.

In the first position, as seen in FIG. 1, the contact pins do not conduct electricity applied to the conductor wires. However, in the second position, as seen in FIG. 2, a pair of incoming wires are electrically connected by the each contact pin.

A female contact block 360 supports eight female socket contacts 340. The female contact block is typically made of a solid body 361 having an electrically non-conducting nature. A front circular surface 362 provides holes 363 for supporting female socket contacts. Fastening means, which typically include a friction-fit, connect the front cylindrical surface 364 of the female contact block with the device housing 240. A rib 365 has a diameter that is approximately equal to the outside diameter of the device housing. A rear cylindrical surface 366 supports an optional end cover housing 260. A rear circular surface 367 provides eight holes 368 corresponding to the eight wires that are embedded in the solid female contact block.

In the preferred embodiment, eight female socket contacts 340 are embedded in holes 363 in the front surface 362 in the solid body 361 of the female contact block 360. Each female socket contact typically provides an electrically conductive cylindrical socket 341 sized to accept a single prong 322 or 323 of the U-shaped contact pins and a crimp connector 342 to allow the socket 341 contact to be attached to the end of a conductor 382 of a wire 380, typically having insulation 381.

Optionally, an end cover 260, sized to snap on the rear cylindrical surface 366 of female contact block 360, may be used. Such an end cover may relieve strain put on the wires 380 and also prevent ingress of dirt and moisture. As seen in FIG. 1, the end cover provides cylindrical inner and outer surfaces 261, 262, a conical rear portion 263, and an end opening 264 through which wire 380 pass.

The key operated vehicle anti-theft electrical switching device of the invention may be installed by utilizing as many as eight wires, potentially representing four separate electrical circuits.

The unit may be physically installed by making an appropriately sized hole, typically in the vehicle's dashboard or other mounting surface 500. As seen in FIG. 18, the device is installed from behind the dash, and the locknut 140 is then threaded onto the threaded band 169 of housing 160 from the front side of the dash. The faceplate may then be installed. By operating the key, the user may either make or break the four electrical circuits. If those circuits include the starter motor and the ignition circuits, then unauthorized persons will be prevented from operating the vehicle.

The previously described versions of the present invention have many advantages, including the advantage of a novel vehicle anti-theft device that allows a driver to disable a car by creating electrical discontinuities in up to four electrical circuits by means of a keyed switching device.

Another advantage of the present invention is to provide a vehicle anti-theft device that is easily concealed and that is not typically expected by car thieves.

Another advantage of the present invention is to provide a vehicle anti-theft device that is inexpensive to purchase and to install.

Another advantage of the present invention is to provide a vehicle anti-theft device that is easy for a driver to consistently use when leaving the car.

A still further advantage of the present invention is to provide a vehicle anti-theft device that may be installed easily as an after-market product, and that is easily adapted to almost any motor vehicle.

Although the present invention has been described in considerable detail and with reference to certain preferred versions, other versions are possible. For example, while eight wires representing four circuits is considered optimal, it is clear that the number of circuits is somewhat arbitrary, and a greater or lesser number could be chosen. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A key-operated vehicle anti-theft electrical switching device, attachable to a vehicle having an electrical system, comprising:

(A) an elongate device housing having an axial chamber and a keyway;

(B) a lock mechanism, carried by the device housing, the lock mechanism having a spindle that rotates as a key is turned in the lock mechanism, the spindle carrying a drive pin oriented perpendicularly to the spindle;

(C) a helix bushing, comprising:

(a) a cylindrical body having an axial channel, carried by the device housing and slidable within the device housing in an axial direction, the cylindrical body having an inside surface and an outside surface;

(b) raised key means, protruding from the outside surface of the cylindrical body, for travel in the keyway and for preventing rotation of the helix bushing;

(c) at least one helix groove in the inside surface of the cylindrical body, the groove sized to receive the drive pin; and (d) a rear interlock structure, carried by the cylindrical body;

(D) a male contact block, comprising:

(a) a cylindrical body, carried by the device housing and slidable within the axial chamber of the device housing in an axial direction; and (b) a front interlock structure, carried by the cylindrical body, and engageable with the rear interlock structure of the helix bushing;

(E) at least one U-shaped solid contact pin, carried by the male contact block;

(F) a female contact block, carried by the device housing; and (G) at least two female contact sockets, carried by the female contact block, each contact socket sized to receive a prong of the U-shaped solid contact pin, each contact socket having connector means for attaching to the conductor of a wire from the vehicle's electrical system.

2. The key-operated vehicle anti-theft electrical switching device of claim 1, further comprising:

(a) a threaded lock housing having a threaded outside surface, carried by the device housing; and (b) locknut means, threadedly carried by the threaded outside surface of the threaded lock housing, for mounting the switching device on a mounting surface.

3. The key-operated vehicle anti-theft electrical switching device of claim 2, additionally comprising:

(A) the rear interlock structure comprising:

(a) an annular shoulder surface;

(b) an annular recess, adjacent to the annular shoulder surface; and (c) an annular rib adjacent to the annular shoulder surface; and (B) the front interlock structure comprising:

(a) a conical rim;

(b) an annular shoulder surface, adjacent to the conical rim and sized to engage the annular shoulder surface of the rear interlock structure; and (c) an annular recess, adjacent to the annular shoulder surface and sized to receive the annular rib of the rear interlock structure.

4. The key-operated vehicle anti-theft electrical switching device of claim 3, further comprising a retaining bushing, carried by the spindle, having an outside cylindrical surface sized to fit against the inside surface of the helix bushing.

5. The key-operated vehicle anti-theft electrical switching device of claim 4, further comprising an end cover housing, carried by the female contact block.

6. A key-operated vehicle anti-theft electrical switching device for attachment to the electrical system of a vehicle, comprising:

(A) an elongate device housing defining an axial chamber and a keyway;

(B) a lock housing, carried by the device housing, having a radially directed annular flange;

(C) a lock mechanism, carried by the lock housing, the lock mechanism having a spindle that rotates as a key is turned in the lock mechanism, the spindle carrying a drive pin oriented perpendicularly to the spindle;

(D) a helix bushing, comprising:

(a) a cylindrical body defining an axial channel, carried by the device housing and slidable within the device housing in an axial direction, the cylindrical body having an inside surface and an outside surface;

(b) a raised key, protruding from the outside surface of the cylindrical body and oriented in the axial direction and sized to travel in the axial direction within the keyway;

(c) at least one helix groove defined in the inside surface of the cylindrical body sized to receive the drive pin; and (d) a rear interlock structure, carried by the cylindrical body, comprising:

(i) an annular shoulder surface;

(ii) an annular recess, adjacent to the annular shoulder surface; and (iii) an annular rib adjacent to the annular shoulder surface;

(e) a male contact block, comprising:

(i) a cylindrical body, carried by the device housing and slidable within the device housing in the axial direction; and (ii) a front interlock structure, carried by the cylindrical body, and engageable with the rear interlock structure of the helix bushing, comprising:

(a) a conical rim;

(b) an annular shoulder surface, adjacent to the conical rim and sized to engage the annular shoulder surface of the rear interlock structure; and (c) an annular recess, adjacent to the annular shoulder surface and sized to receive the annular rib of the rear interlock structure;

(f) at least one U-shaped solid contact pin, carried by the male contact block, each solid contact pin comprising a base electrically connecting a first prong and second prong;

(g) a female contact block, carried by the device housing;

(h) at least two female contact sockets, carried by the female contact block, each contact socket sized to receive a prong from the U-shaped solid contact pin, each socket comprising:

(i) a cylindrical socket; and (ii) crimp connector means, electrically in contact with the cylindrical socket, for crimping about the conductor of a wire and thereby making electrical contact with that wire;

(i) the lock housing having a threaded outside surface;

(j) locknut means, threadedly carried by the threaded outside surface of the threaded lock housing, for mounting the switching device on a mounting surface;

(k) a retaining bushing, carried by the spindle, having an outside cylindrical surface sized to fit against the inside surface of the helix bushing; and (l) an end cover, carried by the female contact block.

* * * * *